US008127505B2

(12) United States Patent
Lu et al.

(10) Patent No.: US 8,127,505 B2
(45) Date of Patent: Mar. 6, 2012

(54) ASSEMBLY TYPE WALL STRUCTURE

(76) Inventors: Chen-Yin Lu, Taoyuan County (TW); Ying-Chung Lan, Taoyuan County (TW)

( * ) Notice: Subject to any disclaimer, the term of this patent is extended or adjusted under 35 U.S.C. 154(b) by 385 days.

(21) Appl. No.: 12/300,775

(22) PCT Filed: May 15, 2006

(86) PCT No.: PCT/CN2006/000960

§ 371 (c)(1),
(2), (4) Date: Nov. 13, 2008

(87) PCT Pub. No.: WO2007/131387

PCT Pub. Date: Nov. 22, 2007

(65) Prior Publication Data

US 2009/0183450 A1 Jul. 23, 2009

(51) Int. Cl.
*E04C 2/288* (2006.01)

(52) U.S. Cl. ..... 52/220.2; 52/302.3; 52/302.4; 52/582.1; 52/585.1; 52/586.1; 52/783.1; 52/791.1

(58) Field of Classification Search ..... 52/220.2, 52/302.1, 302.3, 302.4, 582.1, 585.1, 586.1, 52/783.1, 790.1, 791.1, 794.1, 795.1, 248
See application file for complete search history.

(56) References Cited

U.S. PATENT DOCUMENTS

| | | | | | |
|---|---|---|---|---|---|
| 2,101,036 | A | * | 12/1937 | Olbrich | 217/4 |
| 2,722,120 | A | * | 11/1955 | Dalton | 52/346 |
| 4,353,193 | A | * | 10/1982 | Sanderson | 52/476 |
| 4,577,444 | A | * | 3/1986 | Sanderson | 52/475.1 |
| 5,799,454 | A | * | 9/1998 | Andersson et al. | 52/302.3 |
| 6,000,194 | A | * | 12/1999 | Nakamura | 52/783.17 |
| 6,202,381 | B1 | * | 3/2001 | Dame et al. | 52/745.1 |
| 6,457,288 | B2 | * | 10/2002 | Zambelli et al. | 52/220.2 |
| 2003/0167715 | A1 | * | 9/2003 | Messenger et al. | 52/309.12 |

FOREIGN PATENT DOCUMENTS

| | | |
|---|---|---|
| CN | 1415820 | 5/2003 |
| DE | WO8801664 | 3/1988 |

OTHER PUBLICATIONS

Chen-Yin Lu PCT/CN2006/000960 International Search Report dated Feb. 15, 2007.

* cited by examiner

*Primary Examiner* — Brian Glessner
*Assistant Examiner* — Adam Barlow
(74) *Attorney, Agent, or Firm* — Chun-Ming Shih

(57) ABSTRACT

An assembly type wall structure is disclosed. The assembly type wall structure may be used as a vertical wall in an interior space and includes a plurality of wall units. Each wall units together to form a wall and may connect this wall with the corresponding ceiling, walls and floor of the interior space. Hence, the assembly type wall structure may be used as a vertical wall in an interior space and has the advantages of fast and simple implementation.

6 Claims, 8 Drawing Sheets

ASSEMBLY TYPE WALL STRUCTURE

BACKGROUND OF THE INVENTION

1. Field of the Invention

The present invention relates to an assembly type partition wall structure, and more particularly, to an assembly type partition wall structure utilizing a technique of interior space design in which a plurality of partition wall units are joined by connecting side by side successively to form a continuous wall panel so as to easily form a vertical partition of a three-dimensional spacing.

2. Description of the Prior Art

How to make a perfect space plotting has been a deeply concerned matter of human being. As our living environments, the earth, cities, parks, stages or stadiums, and building stories all belong to natural or artificial three-dimensional spaces, architectures have been doing their best efforts to work out a perfect design to make such spaces pleasant for people to live in. In order to improve a visual feeling of the living space, vertical partition wall structure in the building is considered to be the best way that it has been widely adopted in the building interior.

In early days, the primitive brick wall material is used to bond together with binders to support the structure. Afterwards, the C steel frame structure associated with hard board material is employed to form a light partition system, pour light concrete material, or use the metal troughs to construct an equivalent system.

However, the aforesaid partition wall structure are found to have the following disadvantages, namely:

1. Construction work has to rely on well-trained skillful workers to accomplish.

2. In the case of brick work, the brick must be stacked up one by one with the mortar intercalated there between tediously wasting time.

3. The utility ducts such as electricity, gas and water involved in the wall structure are difficult for regular maintenance.

All above mentioned structures have the common demerits of requiring long working time with technical difficulty. Above all, the light concrete system and mental trough system need high construction cost, and the metal trough system has a poor capability to resist fire.

SUMMARY OF THE INVENTION

For these defects noticeable on the prior art, an improvement is seriously required. It is the main object of the present invention to provide an assembly type partition wall structure, which is applicable to any figured space and easily fabricable with low cost for improving human life.

To achieve the above object, the present invention provides a partition wall unit including a quadrilateral main wall body having a L shaped first connecting plate linearly extended from the front end along two adjacent sides with a thickness half that of the main wall body, and another L shaped second connecting plate linearly extended from the front end along the other two adjacent sides with a thickness half that of the main wall body. Moreover, there are several horizontal ducts and several vertical ducts provided in the main wall body both ducts in communication with one another. There are tapped holes formed respectively on the first and second connecting plates. There are two layers of metallic net intercalated in the main wall body between the corners of aforesaid horizontal and vertical ducts. There are provided several supporting frames disposed longitudinally and transversely in the main wall body at the outer side of the two metallic nets. One side of the first connecting plate of a partition wall unit is just able to joint with corresponding side of the second connecting plate of another partition wall unit.

In the present invention, a continuous wall panel can be formed by jointing side by side the plurality of aforesaid partition wall units. At least one steel hoop is provided around the circumference of the partition wall unit assembly to fasten the partition wall units jointed side by side in the three-dimensional spacing. The steel hoop consists of a rim band secured to the bottom edge of the space, and the rim band is outwardly bent in vertical direction to form an assembly frame which being facing to the first and second connecting plates of each partition wall unit.

With this structure, a continuous wall panel is formed by jointing side by side the first and second connecting plates of the adjacent partition wall units, and by combining and fastening the circumferential edge of each partition wall unit of the continuous wall with the steel hoop in the three-dimensional space. A closed partition space can be formed easily, promptly and firmly in a short time with a reduced cost.

BRIEF DESCRIPTION OF THE DRAWINGS

Other objects and purposes of the invention will be apparent to persons acquainted with apparatus of this general type upon reading the following specifications and inspection of the accompanying drawings.

DETAILED DESCRIPTION OF THE PREFERRED EMBODIMENT

Figure 1:
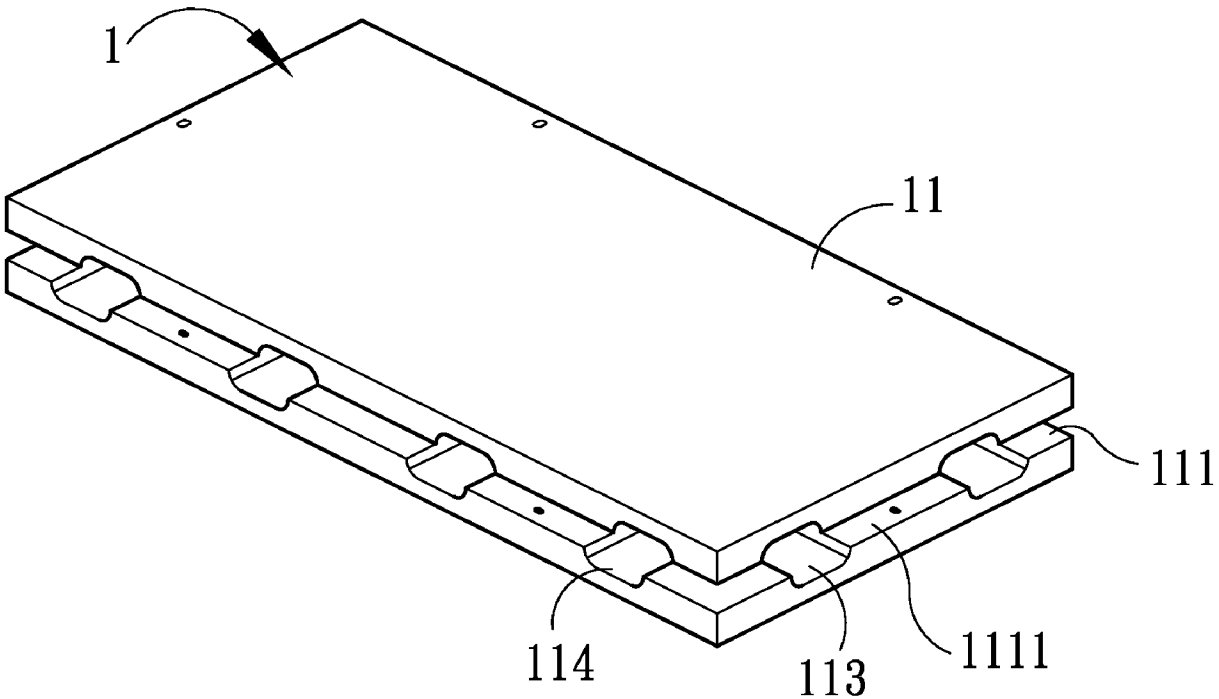
FIG. 1 is a perspective view of the partition wall unit of the present invention.
Figure 2:
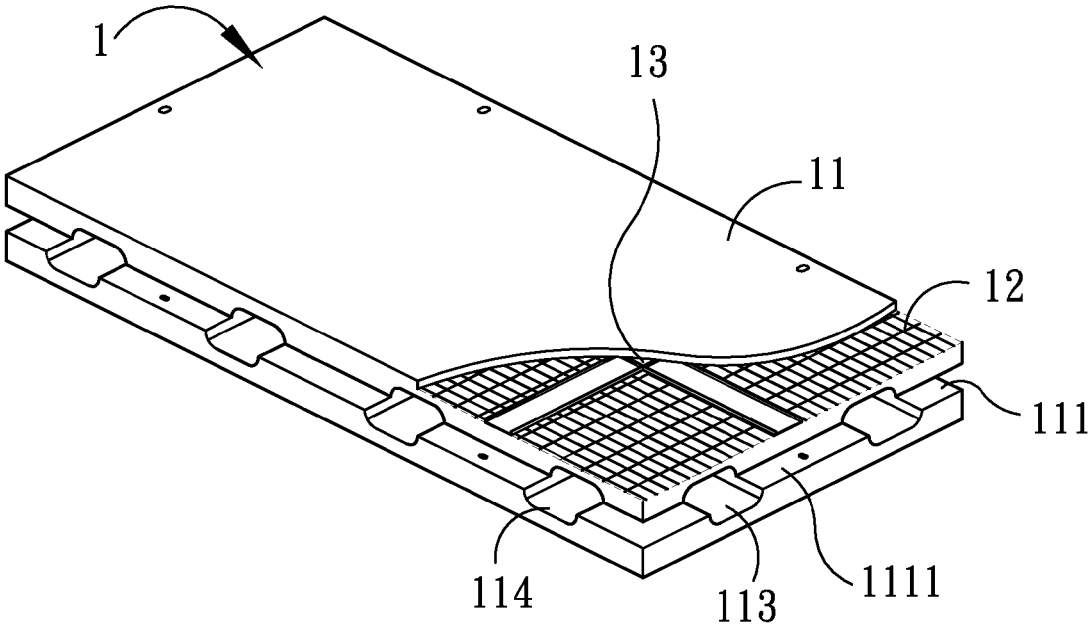
FIG. 2 is a fractional view of the partition wall unit of the present invention.

Now a preferred embodiment of the present invention will be described in detail with reference to the subjoined drawings.

Referring to FIGS. 1, 2, 3, 5 and 8, the present invention vertically divides the three-dimensional space with a plurality of partition wall units 1 and connects them side by side to form a continuous wall panel, and at least a steel hoop 2 is used to secure the continuous wall panel around its circumferential edge. Furthermore, a hoop bar 3 is filled into the gap between the steel hoop 2 and the partition wall units 1.

As show in FIG. 1 through FIG. 4, the partition all unit is composed of a main wall body 11 figured into a quadrilateral concrete structure, a L shaped first connecting plate 111 with a thickness half as that of the main wall body 11 is extended from its front end linearly along two adjacent sides; and another L shaped second connecting plate 112 with a thickness half as that of the main wall body 11 is extended from its front end linearly along other two adjacent sides. A first bond face 1111 and a second bond face 1121 are respectively formed in the inner sides of the first and second connecting plates 1111 and 1121, wherein the two bond faces 1111 and 1121 are bonded together with their corresponding ends. There are several horizontal ducts 113 and vertical ducts 114 in communication one another are provided in the main wall body 11. A tapped hole 4 is provided respectively on the first and second connecting plates 111 and 112. There are two layers of metallic net 12 intercalated in the main wall body 11 between two corners of aforesaid horizontal and vertical ducts 113 and 114. There are provided several supporting frames 13, which being made of metal material approximately in C shape, disposed longitudinally and transversely in the main wall body 11 at the outer side of the two metallic nets 12. One side of the first connecting plate 111 of a partition wall unit 1 is just able to joint with corresponding side of the second connecting plate 112 of another partition wall unit 1.

Figure 3:
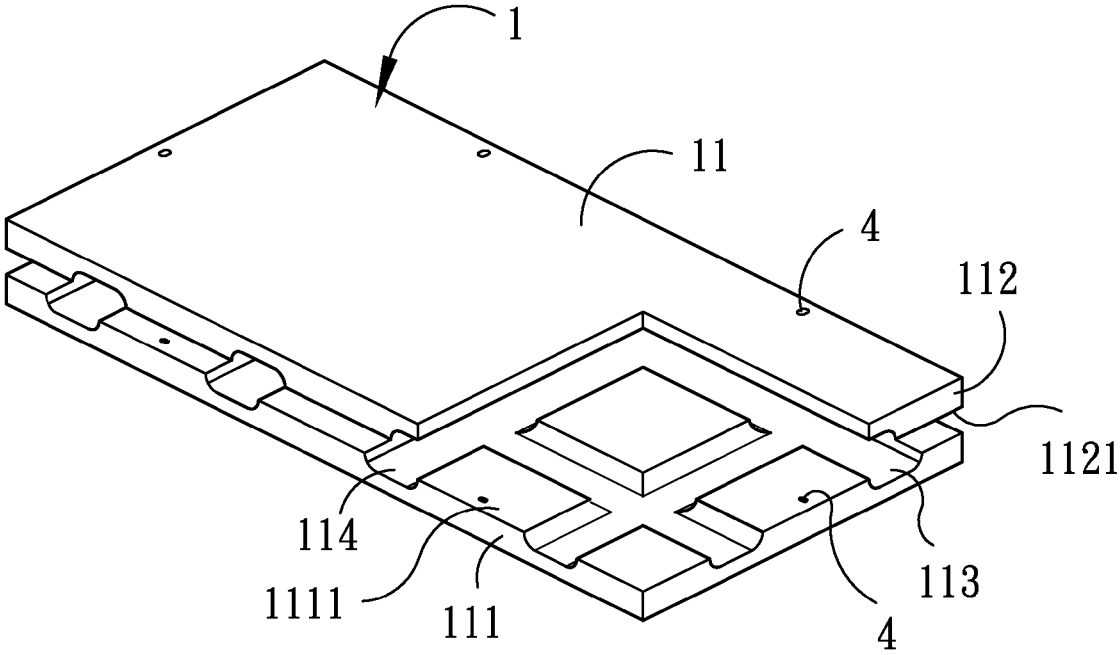
FIG. 3 is another fractional view of the partition wall unit of the present invention.
Figure 4:
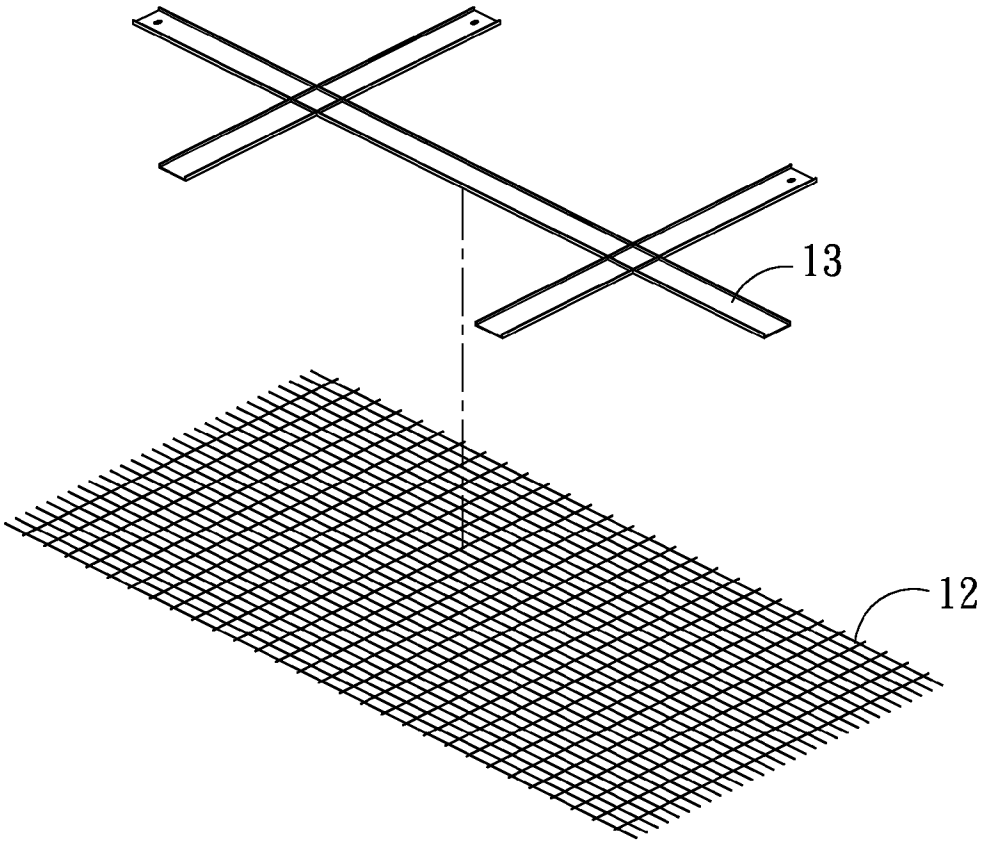
FIG. 4 is an exploded view of the metallic net and its supporting frame of the present invention.
Figure 5:
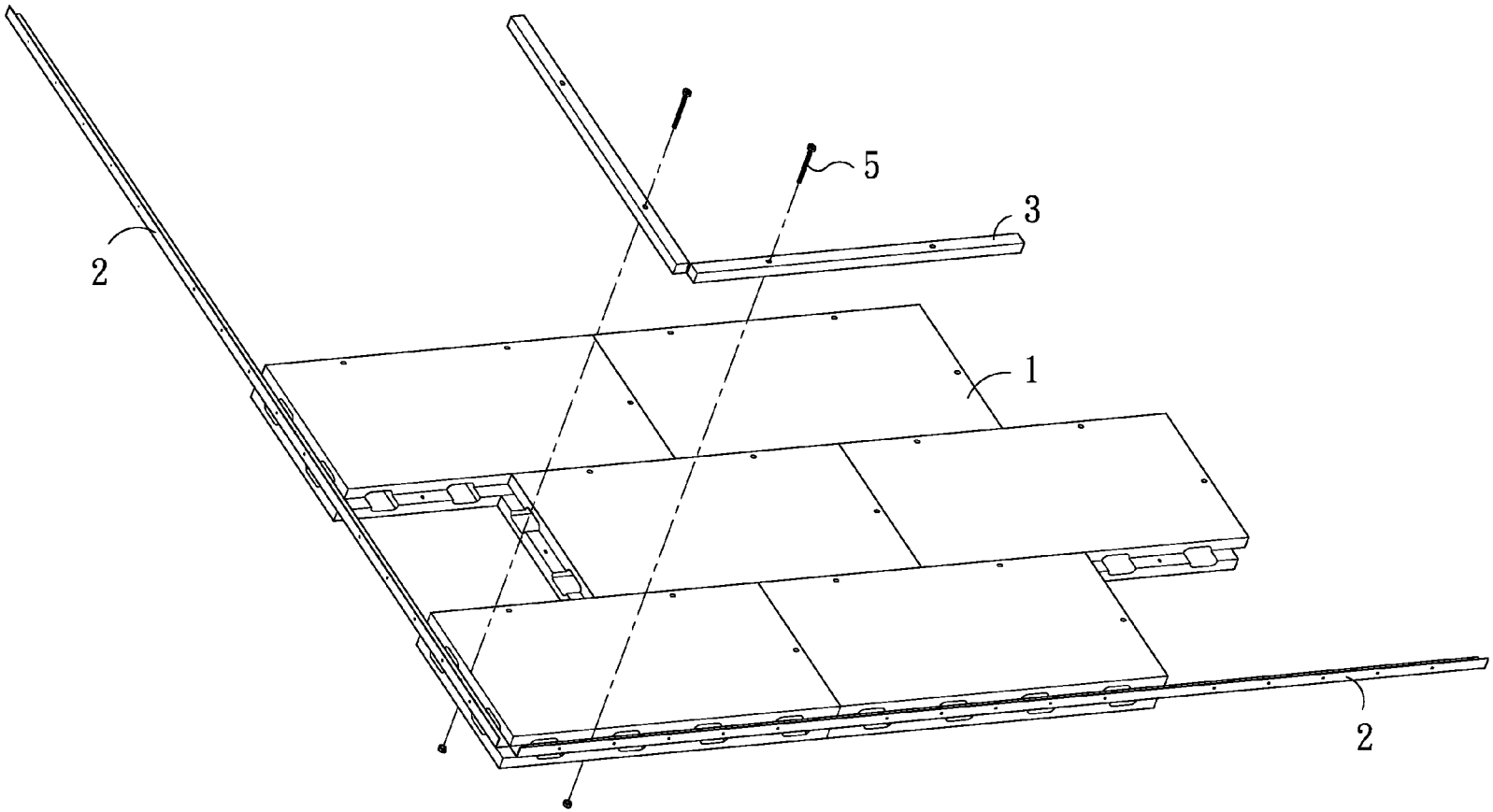
FIG. 5 is a schematic view showing assembling of the present invention.
Figures 6, 6A:
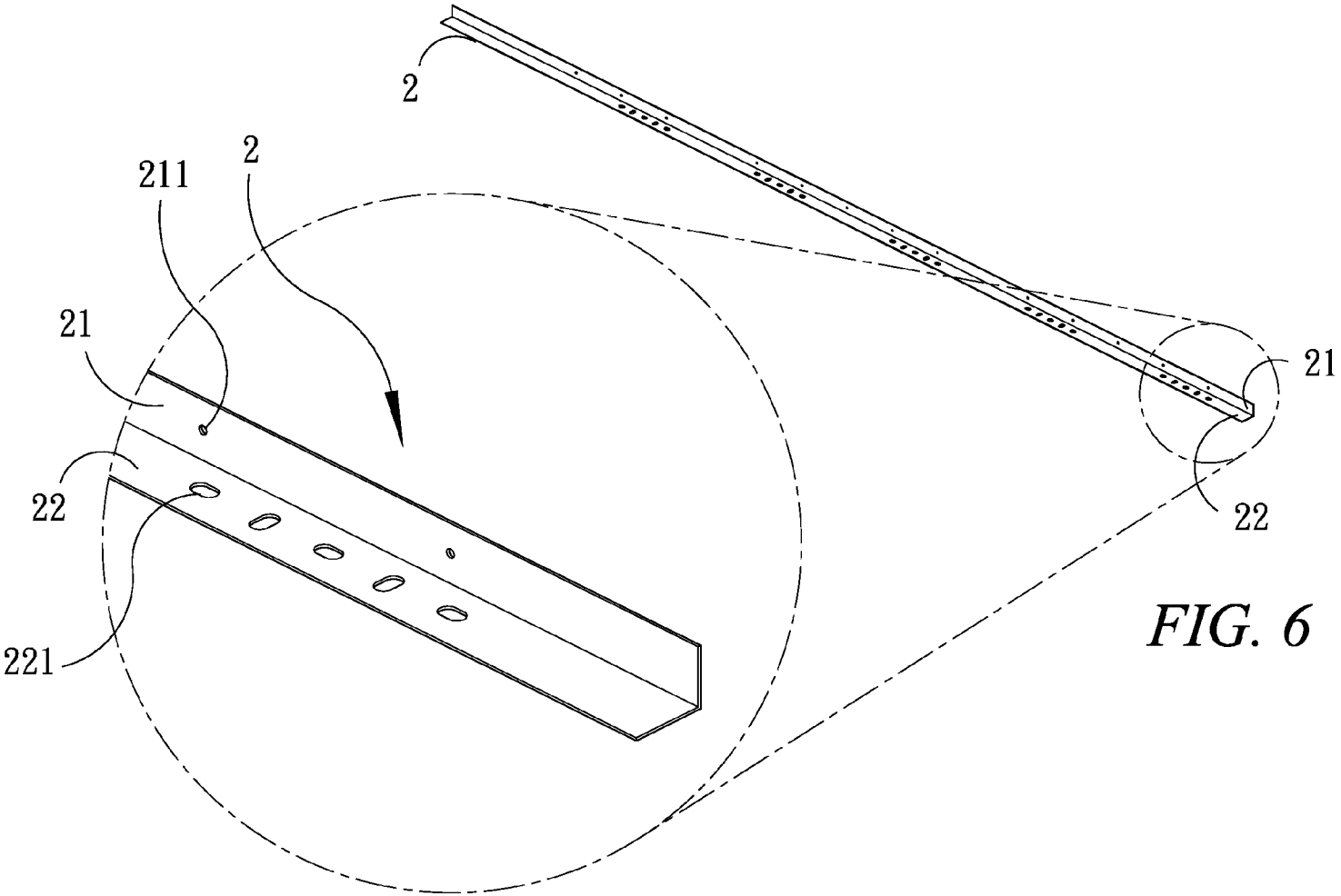
FIG. 6 is a perspective view showing the steel hoop of the present invention.
FIG. 6A is a fractional enlarged view of the steel hoop of the present invention.
Figure 7:
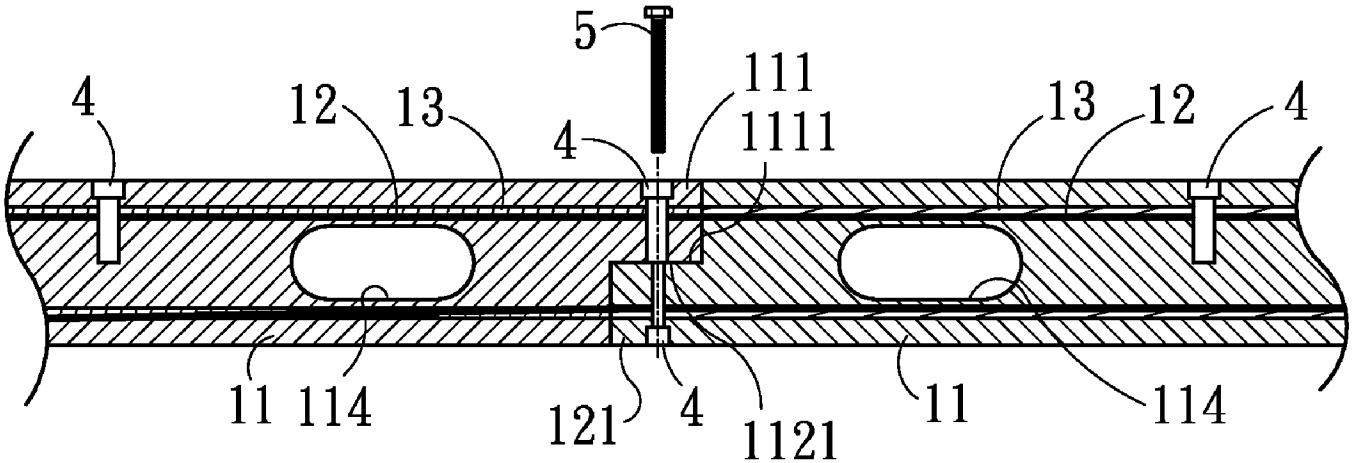
FIG. 7 is a cross sectional view of two jointed partition wall unit.

As shown in FIGS. 5, 6 and 6A, the steel hoop 2 has a rim band 21 which can be secured to any one of the bottom, top and side of the space. The rim band 21 has a width slightly less than ½ that of the main wall body 11, and several through holes 211 are provided on the rim band 21. Furthermore, the rim band 21 is outwardly bent in vertical direction to from an assembly frame 22 which being facing to the first bond face 1111 of the first connecting plate 111 and the second bond face 1121 of the second connecting plate 112, and several through holes 221 are provided on the assembly frame 22 each of them is aligned to the corresponding tapped hole 4 as shown in FIGS. 3 and 7.

Figure 8:
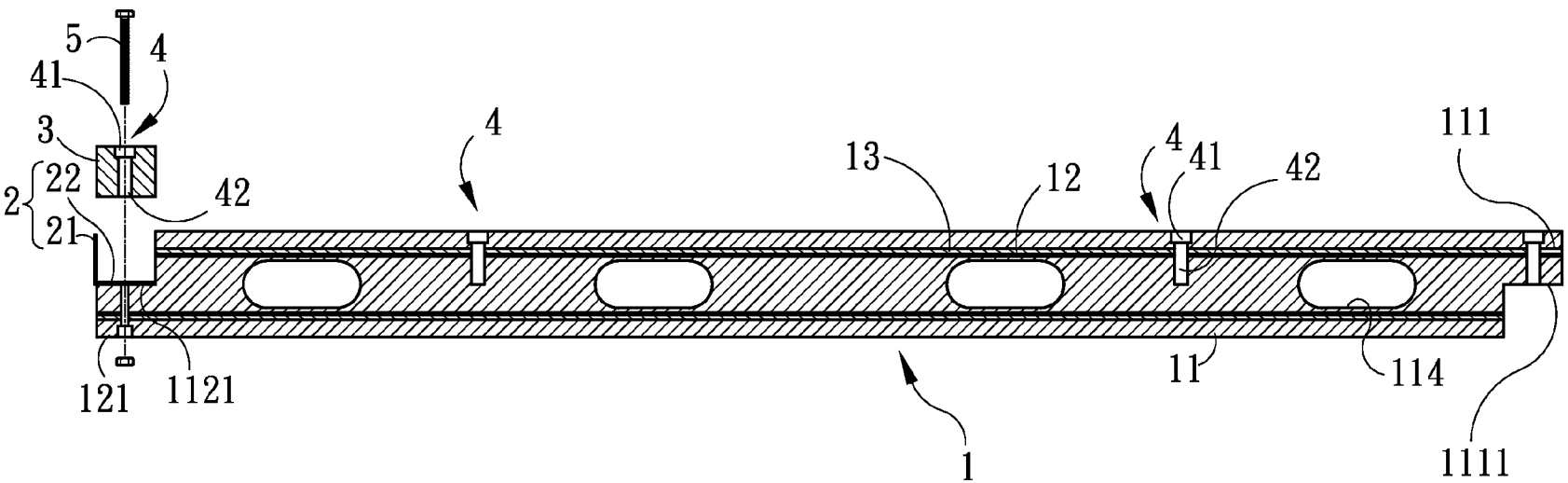
FIG. 8 is a cross sectional view showing the structural relation between the partition wall unit and the steel hoop.
Figure 9:
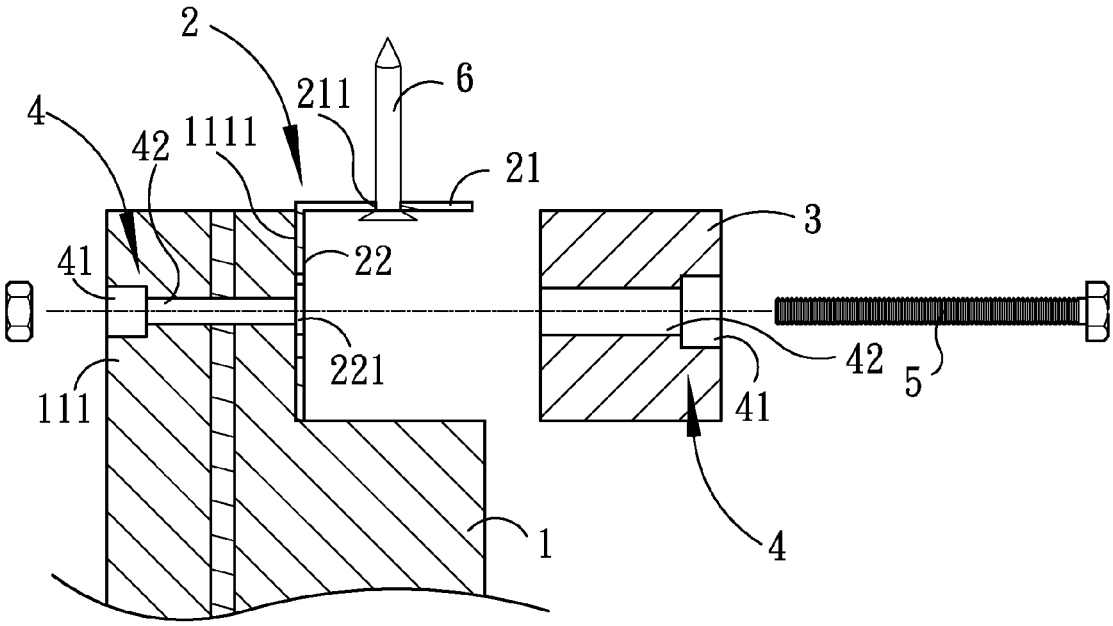
FIG. 9 and FIG. 10 are fractional cross sectional vies showing the partition wall unit is secured to the steel hoop by bolts and joint members.
Figure 10:
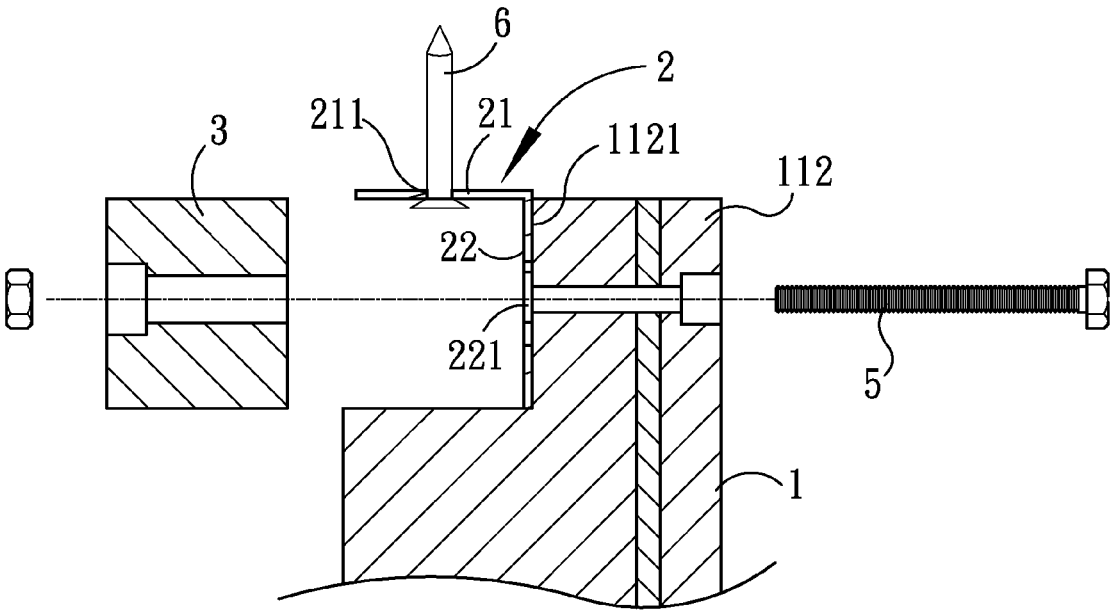

As shown in FIGS. 5 and 8, the hoop bar 3 is made of concrete to be filled into the steel hoop 2 between its rim band 21 and assembly frame 22, and an outer side of the hoop bar 3 is firmly secured to the main wall body 11 of the partition wall unit 1. Besides, there are provided several tapped holes on the hoop bar 3 respectively aligning to the through holes 221 on the assembly frame 22 of the steel hoop 2 and the tapped holes 4 respectively formed on the first and second connecting plate 111 and 112 of each partition wall unit 1.

As shown in FIGS. 1, 2, 6A and 8, each tapped hole 4 consists of an outer hole 41 and its coaxial smaller inner hole 42, wherein the through hole 221 of the steel hoop 2 is aligned to the inner hole 42. The inner hole 42 is configurated approximately into an elliptical shape so as to let a bolt member 5 pass through the tapped hole 4 and its corresponding through hole 221 with some allowance to adjust the position of the bolt member 5 such that the partition wall unit 1, the steel hoop 2, and the hoop bar 3 can be combined with a relevant tightness.

Referring again to FIG. 2 through FIG. 5, FIGS. 6A, 7, 9 and 10, when in assembling, at first the steel hoop 2 is settled either on the bottom, top or side of the three-dimensional space with its rim band 21 leaning against the side of the space, and nail a joint member 6 (steel nail for example) through the through hole 211 on the rim band 21.

Next, combining side by side the first bond face 1111 of the first connecting plate 111 and the second bond face 1121 of the second connecting plate 112 of the main wall body 11 selected from any two partition wall unit 1. The structure is secured using the bolt members 5 to screw through the tapped holes 4 provided on the first and second connecting plates 111 and 112 so as to form a continuous wall panel combining the multiple numbers of partition wall units 1. Afterwards, bonding the first bond face 1111 of the outer end first connecting plate 111 of the last partition wall unit 1 (or the second bond face 1121 of the second connecting plate 112) to the rear side of the assembly frame 22 of the steel hoop 2 set in the three dimensional space, and installing the hoop bar 3 in the steel hoop 2 between its rim band 21 and assembly frame 22, and finally securing tightly the side of the continuous wall panel formed of partition wall units 1 with the steel hoop 2 and the hoop bar 3 using the bolt members 5 to screw into the tapped holes 4 on the first and second connecting plate 111, 112 to pass through the through holes 221 provided on the assembly frame 22 of the steel hoop 2 and the tapped holes 4 of the hoop bar 3 thereby closing the entire three-dimensional space with a continuous wall panel formed of a plurality of partition wall units 1 mutually combined side by side.

The mission of utility power, gas and water supply to the building can be performed by the horizontal and vertical ducts 113 and 114 communicatively run in the continuous wall panel without any difficulty in maintenance when necessary.

It emerges from the description of the above example that the invention has several noteworthy advantages, in particular:

1. The partition wall units 1 can be easily assembled at the working site without the need of skilled workmen, so the cost is low.

2. The assembly work of the present invention is much easier and time and cost saving compared with the conventional partition work.

3. The utility power, gas and water supply can be performed by the horizontal and vertical ducts communicatively run in the continuous wall. No special installation is required which may have to break the wall surface.

4. The present invention is well applicable to industrious utilization because of its novelty, versatility and progressiveness.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

What is claimed is:

1. An assembly type partition wall structure to vertically divide a three-dimensional space, comprising:

a continuous wall panel formed by jointing side by side a plurality of partition wall units, wherein each partition wall unit has a quadrilateral main wall body having a first connecting plate extended from two adjacent sides with a thickness half that of said main wall body, and a second connecting plate extended from the other two adjacent sides with a thickness half that of said main wall body, besides, there are several horizontal ducts and several vertical ducts provided in the main wall body both ducts being in communication with one another;

two layers of metallic net respectively disposed above and under said horizontal and said vertical ducts in said wall body;

a hoop consisting of a rim band being provided around the circumference of said continuous wall panel and an assembly frame being extended from the rim band and disposed on said first or said second connecting plate of each said partition wall unit; and the continuous wall panel formed by jointing side by side said first and said second connecting plates of more than two adjacent partition wall units, and by combining and securing the circumferential edge of each partition wall unit of said continuous wall panel with said hoop in the three-dimensional space to form a closed partition space, wherein a hoop bar is filled into said hoop between its rim band and assembly frame, and an outer side of said hoop bar is secured to said main wall body of the partition wall unit.

2. The assembly type partition wall structure of claim 1, wherein the width of said rim band of the hoop is slightly less than half the thickness of said main wall body.

3. The assembly type partition wall structure of claim 2, wherein several through holes are provided on said rim band of the hoop.

4. The assembly type partition wall structure of claim 1, wherein several tapped holes are provided respectively on said first and said second connecting plates, said tapped holes are aligned to several corresponding through holes provided on said assembly frame, besides, several tapped holes are provided on said hoop bar respectively aligned to the corresponding through holes so as to mutually combine said first and said second connecting plates of each partition wall unit, or bond the assembly frame of said hoop to said hoop bar.

5. The assembly type partition wall structure of claim 4, wherein said tapped hole includes an outer hole aligning to the corresponding through hole of said hoop so as to screw combine said tapped hole and said through hole with a bolt member, and allow said bolt member to adjust its position in said through hole.

6. The assembly type partition wall structure of claim 1, wherein said hoop is installed on the bottom, top or side of said three-dimensional space.

* * * * *